US010411350B2

(12) United States Patent
Thalakotuna et al.

(10) Patent No.: US 10,411,350 B2
(45) Date of Patent: Sep. 10, 2019

(54) REFLECTION CANCELLATION IN MULTIBEAM ANTENNAS

(71) Applicant: CommScope Technologies LLC, Hickory, NC (US)

(72) Inventors: Dushmantha N. P. Thalakotuna, Rosehill (AU); Zhonghao Hu, Westmead (AU); Bevan Beresford Jones, North Epping (AU)

(73) Assignee: CommScope Technologies LLC, Hickory, NC (US)

( * ) Notice: Subject to any disclaimer, the term of this patent is extended or adjusted under 35 U.S.C. 154(b) by 670 days.

(21) Appl. No.: 14/596,939

(22) Filed: Jan. 14, 2015

(65) Prior Publication Data

US 2015/0222015 A1 Aug. 6, 2015

Related U.S. Application Data

(60) Provisional application No. 61/934,545, filed on Jan. 31, 2014.

(51) Int. Cl.
*H01Q 3/40* (2006.01)
*H01Q 1/52* (2006.01)

(52) U.S. Cl.
CPC ..... *H01Q 3/40* (2013.01); *H01Q 1/523* (2013.01)

(58) Field of Classification Search
CPC .. H01Q 5/00; H01Q 5/28; H01Q 3/40; H01Q 3/36; H01Q 25/00; H01Q 1/24; H01Q 1/246; H01Q 21/0006
See application file for complete search history.

(56) References Cited

U.S. PATENT DOCUMENTS 5,264,862 A * 11/1993 Kumpfbeck ..... H01Q 9/18 343/799
5,530,927 A * 6/1996 Smith ..... H03D 9/06 333/99 S (Continued)

FOREIGN PATENT DOCUMENTS

WO WO 2014040957 A1 * 3/2014 ..... H01Q 3/36

OTHER PUBLICATIONS

International Search Report regarding PCT/US2015/011624, dated Apr. 17, 2015 (4pgs.).

(Continued)

*Primary Examiner* — Vladimir Magloire
*Assistant Examiner* — Daniel P Malley, Sr.
(74) *Attorney, Agent, or Firm* — Myers Bigel, P.A.

(57) ABSTRACT

A feed network for a multi-beam antenna is provided, including a first beam port, a second beam port, a beam-forming network coupled to the beam ports, and a cancellation circuit. The cancellation circuit is coupled to the first beam port and the second beam port before the beam-forming network. The cancellation circuit extracts a portion of a RF signal on the first beam port, adds phase delay, and injects the extracted, delayed signal from the first beam port onto the second beam port, and extracts a portion of a RF signal on the second beam port, adds phase shift, and injects the extracted, delayed signal from the second beam port onto the first beam port. In one example of the invention, the cancellation circuit comprises a first directional coupler on a first beam input path, a transmission line, a second directional coupler on the second beam input path.

15 Claims, 4 Drawing Sheets

(56) References Cited

U.S. PATENT DOCUMENTS

| | | | | |
|---|---|---|---|---|
| 7,941,105 | B1 * | 5/2011 | McCall | H04B 1/0458 330/149 |
| 8,253,645 | B2 * | 8/2012 | Derneryd | H01Q 1/52 342/373 |
| 2007/0135168 | A1 * | 6/2007 | Liu | H01Q 3/40 455/562.1 |
| 2009/0028074 | A1 * | 1/2009 | Knox | H01Q 9/0435 370/278 |
| 2009/0184879 | A1 * | 7/2009 | Derneryd | H01Q 1/52 343/853 |
| 2009/0322608 | A1 * | 12/2009 | Adams | H01Q 1/246 342/368 |
| 2010/0002620 | A1 * | 1/2010 | Proctor, Jr. | H01Q 1/521 370/315 |
| 2012/0282872 | A1 * | 11/2012 | Banwell | H04B 1/58 455/269 |
| 2014/0159956 | A1 * | 6/2014 | Fourie | H01Q 1/246 342/367 |
| 2015/0078217 | A1 * | 3/2015 | Choi | H04B 1/525 370/278 |
| 2015/0244072 | A1 * | 8/2015 | Harel | H01Q 3/36 342/372 |

OTHER PUBLICATIONS

Written Opinion of the International Searching Authority regarding PCT/US2015/011624, dated Apr. 17, 2015 (8pgs.).

Notification Concerning Transmittal of International Preliminary Report on Patentability for corresponding Application No. PCT/US2015/011624, dated Aug. 11, 2016, 11 pages.

* cited by examiner

REFLECTION CANCELLATION IN MULTIBEAM ANTENNAS

RELATED APPLICATIONS

This application claims priority to and incorporates by reference U.S. Provisional Patent Application No. 61/934,545, filed Jan. 31, 2014 and titled "Reflection Cancellation In Multibeam Antennas"

BACKGROUND

Multi-beam antennas may be used to reduce the number of antennas on a cellular base station tower. For example, a dual beam antenna is a type of multi-beam antenna that has separate inputs for two beams to be generated, an array of radiating elements, and a beam forming network that applies predetermined and opposite phase shifts to the beam inputs such that the beams are steered off antenna boresight in opposite directions.

One common problem in multi beam antennas is the port to port coupling between the beams that point equally away from the antenna boresight. This is a result of a transmit RF signal of one beam being reflected at the radiating elements, and the beam-forming network coupling the reflected signal through the receive path of a second beam. A high level of coupling between two beams can cause interference and/or damage to the receiver if one beam is transmitting while the other beam is receiving. To avoid this scenario, beam to beam isolation level is specified by an operator. Radiating elements in a multi-beam antenna are generally designed to radiate at a high efficiency to minimize the beam to beam coupling. Even then, certain amount of power from one beam can reflect to the other beam.

SUMMARY

An improved feed network for a multi-beam antenna is provided according to one aspect of the present invention. The feed network includes a first beam port, a second beam port, a beam-forming network, coupled to the first beam port and to the second beam port, and a cancellation circuit. The cancellation circuit is coupled to the first beam port and the second beam port before the beam-forming network. The cancellation circuit is configured to extract a portion of a RF signal on the first beam port, add phase delay, and inject the extracted, delayed signal from the first beam port onto the second beam port, and to extract a portion of a RF signal on the second beam port, add phase shift, and inject the extracted, delayed signal from the second beam port onto the first beam port. In one example of the invention, the cancellation circuit comprises a first directional coupler on a first beam input path, a transmission line, a second directional coupler on the second beam input path, however, other structures may also be used.

The beam forming network may comprise a Butler matrix, a 90° hybrid coupler, or other circuit for receiving two or more RF signals and combining the RF signals with different, predetermined phase shifts such that, when applied to a common array of radiating elements, each of the RF signals are output in a beam that is steered off center from boresight of the array at a distinct angle.

The present invention is advantageously employed in an antenna including an array of radiating elements, where the beam-forming network is further coupled to the array of radiating elements. In such a use, the portion of the RF signal extracted from the first beam port is approximately equal in amplitude to a first beam port RF signal that is reflected by the radiating elements and propagated down a receive path of the second beam port by the beam-forming network, and the portion of the RF signal extracted from the second beam port is approximately equal in amplitude to a second beam port RF signal that is reflected by the radiating elements and propagated down a receive path of the first beam port by the beam-forming network. The portion of the RF signal extracted from the first beam port is phase shifted to be approximately opposite in phase to the first beam port RF signal that is reflected by the radiating elements and propagated down the receive path of the second beam port by the beam-forming network; and the portion of the RF signal extracted from the second beam port is phase shifted to be approximately opposite in phase to the second beam port RF signal that is reflected by the radiating elements and propagated down the receive path of the first beam port by the beam-forming network.

Multi-beam antennas may comprise two, three, four, or more beams. For example, in a three beam antenna, the feed network would further include a third beam port coupled, wherein the third beam port comprises a center beam of the feed network, and the first beam port and the second beam port comprise outer beams of the feed network.

In the example of a four beam antenna, the beam forming network may comprise a Butler matrix. A second cancellation circuit is added. The first and second beam reflections are mutually cancelled against each other in a first cancellation circuit as described above, and third and fourth beam reflections are mutually cancelled against each other in the second cancellation circuit.

DESCRIPTION OF THE INVENTION

Figure 1A:
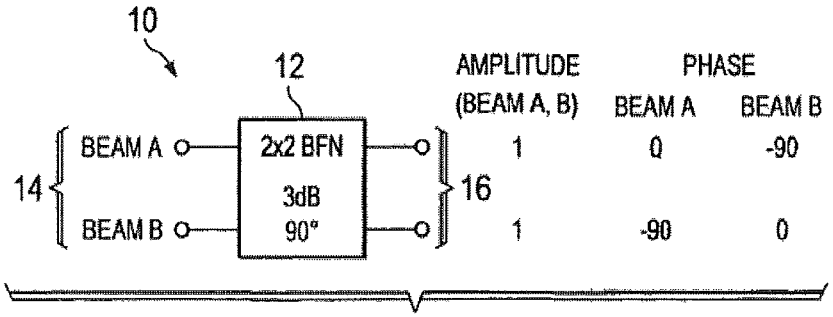
FIG. 1A (PRIOR ART)
FIG. 1A is an illustration of a known hybrid coupler that may be used in a beam forming network in a multi-beam antenna.
Figure 1B:
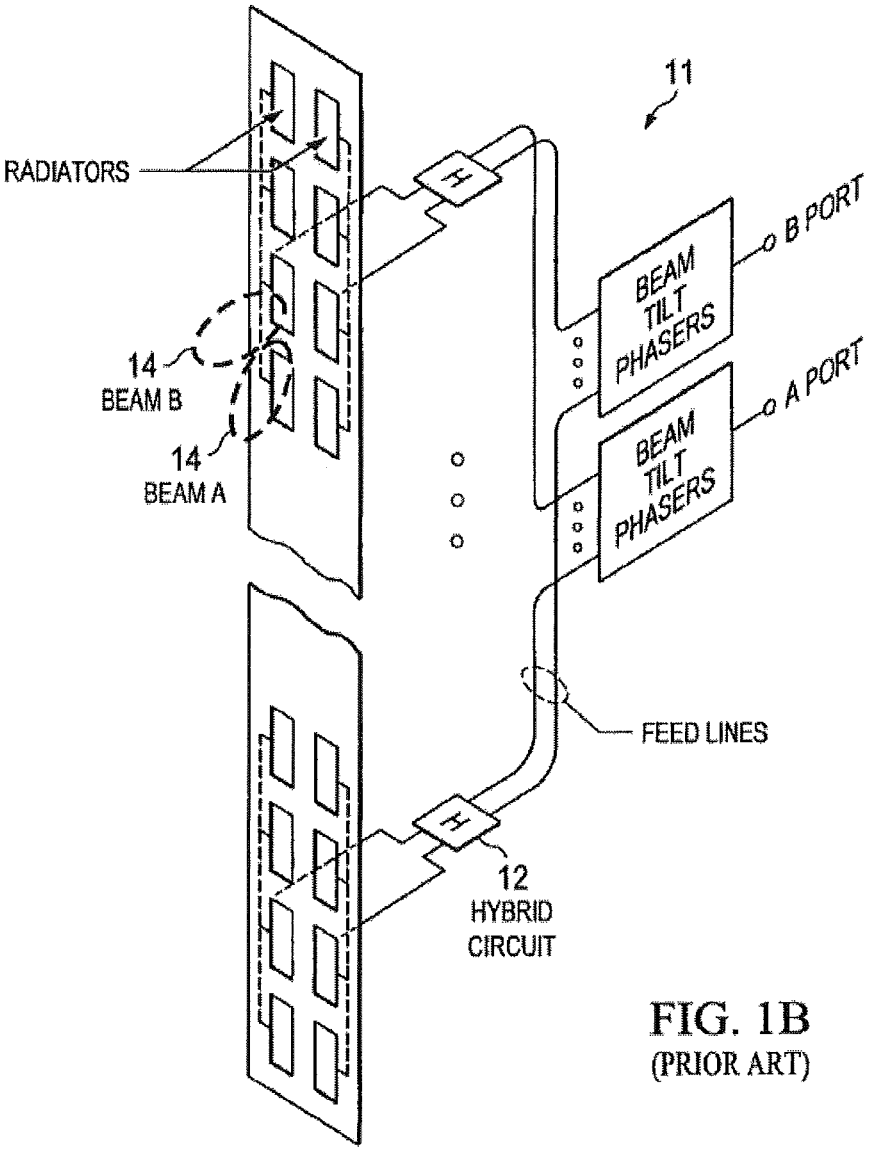
FIG. 1B (PRIOR ART)
FIG. 1B is an illustration of a known dual-beam antenna and feed network.

A schematic of a known dual-beam antenna and associated beam forming network are shown in FIG. 1A and FIG. 1B. Antenna 11 employs a 2×2 Beam Forming Network (BFN) 10 having a 3 dB 90° hybrid coupler 12 and forms both beams A and B in azimuth plane at signal ports 14. (2×2 BFN means a BFN creating 2 beams by using 2 columns). The two radiator coupling ports 16 are connected to antenna elements also referred to as radiators, and the two ports 14 are coupled to the phase shifting network, which is providing elevation beam tilt (see FIG. 1B). However, signals input to Port A may be partially reflected at the radiators and coupled in the receive direction onto Port B by hybrid coupler 12.

While 90° hybrid coupler 12 is sufficient to drive elements in a two column array and create two beams, as illustrated in FIG. 1, more control over beam shaping, or more beams, may be desired. A Butler matrix is a beam forming network that includes 90° hybrid couplers and phase delay elements to create multiple beams. Multiple beams may also be formed using 3 db power dividers and phase delay elements. The term "beam forming network", as used herein, refers to any such network, including 90° hybrid couplers, Butler matrix circuits, power dividers, phase delay elements, and combinations thereof, for receiving two or more RF signals and combining the RF signals with different, predetermined phase shifts such that, when applied to a common array of radiating elements, each of the RF signals are output in a beam that is steered off center from antenna boresight of the array at a distinct angle.

Figure 2:
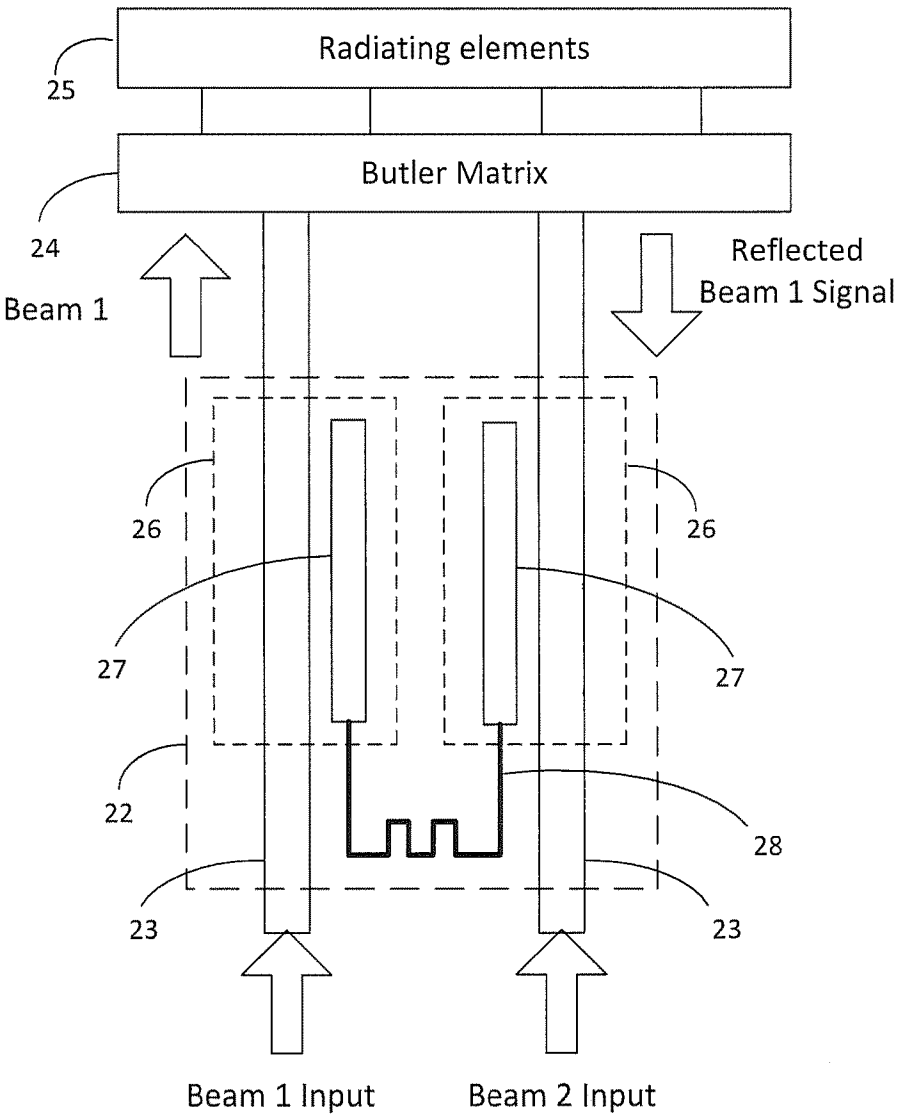
FIG. 2 illustrates a reflection cancellation circuit according to one aspect of the present invention.

A coupling cancelation scheme is provided herein to cancel a reflected transmit RF signal of a first beam from propagating onto the receive path of a second beam. Referring to FIG. 2, a feed network 20 with reflected beam cancellation is illustrated. In this example, there are two beam inputs, Beam 1 and Beam 2. Transmission lines 23 couple Beam 1 and Beam 2 to a Butler matrix 24, which is a type of beam forming network. Additionally, the signals for Beam 1 and Beam 2 are passed through a reflection cancellation circuit 22 before being coupled to Butler matrix 24. The Butler matrix 24 is then coupled to an array of radiating elements 25.

Beam cancellation circuit 22 extracts a portion of the signal from Beam 1, add a phase delay, and feeds it back to the receive path for Beam 2. The amplitude of the extracted portion should match the amplitude of the reflected signal. The phase delay is selected to be out of phase with the reflected signal. The reflection of Beam 1 that comes in the path of Beam 2 combines out of phase with the extracted signal from the Beam 1. As a result, the reflection is partially or fully canceled out at the input of Beam 2. The same cancellation is performed with respect to reflections from Beam 2 into the Beam 1 receive path.

In one example of the present invention, the reflection circuit comprises two directional couplers 26 and a transmission line 28 to provide a phase delay. In one example of a direction coupler 26, as illustrated in FIG. 2, edge couplers 27 may be used. In another example, a directional coupler 26 may be formed by arranging printed circuit board tracks on opposite sides of a PCB, and coupling occurs between the planar areas of the tracks. One directional coupler 26 is provided on each beam input path. Since the amount of coupling required for this feedback is determined based on the amount of reflection of the first beam to the second beam, the amplitude of the extracted signal may be adjusted by adjusting the strength of the coupling between the elements. The phase of the extracted signal should be adjusted by adjusting a length of the transmission line 28 from one directional coupler 26 to the other. Implementation of this cancellation scheme can be done at any point between Butler matrix 24 and the beam inputs.

Figure 3:
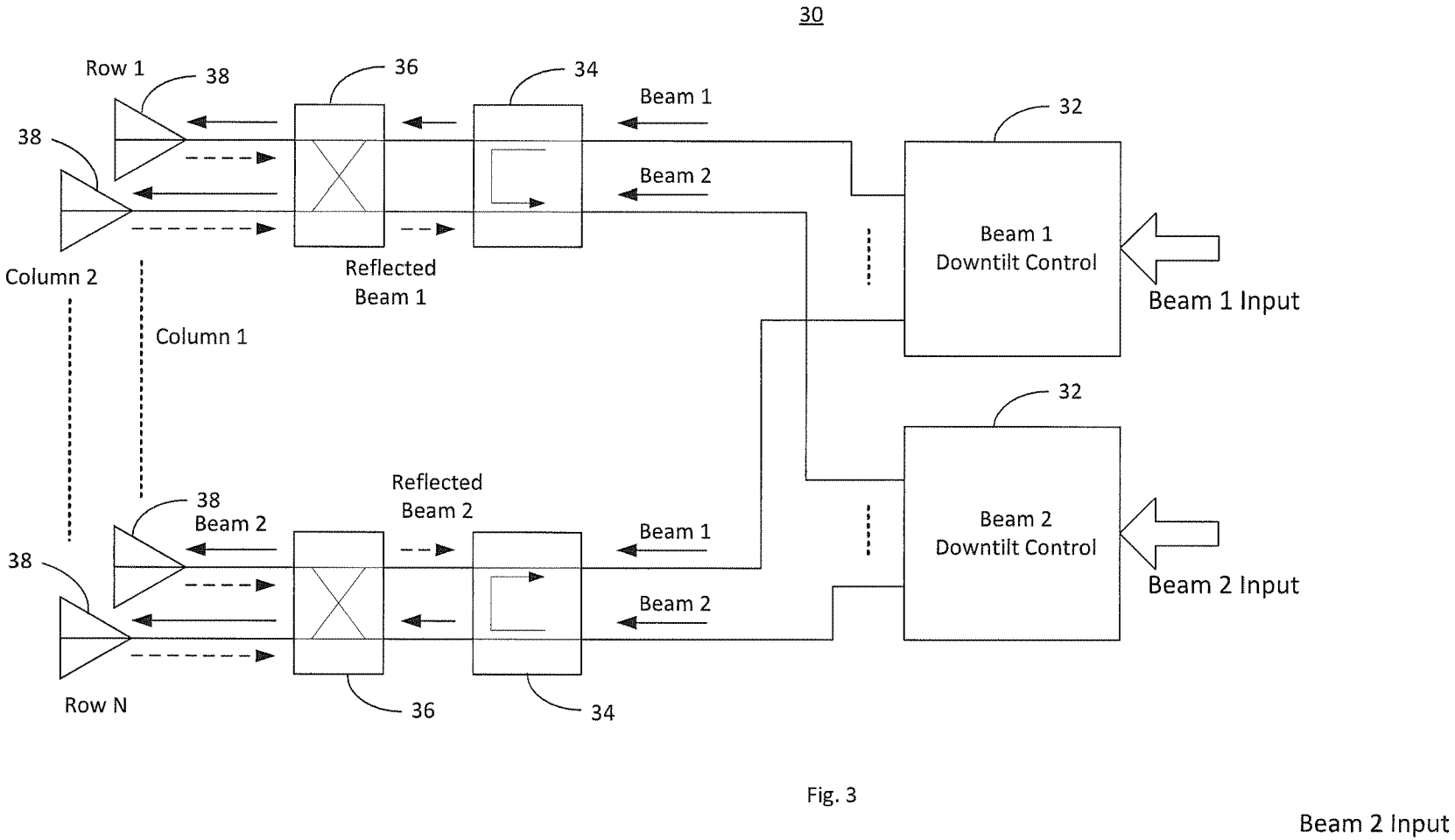
FIG. 3 illustrates a dual-beam antenna and feed network incorporating reflection cancellation circuits according to one aspect of the present invention.

Referring to FIG. 3, a dual beam antenna 30 is illustrated. Antenna 30 comprises inputs for Beam 1 and Beam 2, Beam 1 and Beam 2 downtilt controls 32, reflection cancellation circuits 34, hybrid couplers 36 and radiator elements 38. In this example, the beam cancellation is performed between the beam downtilt controls 32, and the hybrid couplers 36. While only two rows (Row 1, Row N) are illustrated, it will be understood by a person of ordinary skill in the art that any number of rows may be implemented to shape and direct elevation beam shape. For each row, a reflection cancellation circuit 34 is implemented between the beam downtilt controls 32 and a beam-forming hybrid coupler 36. The reflection cancellation circuit 34 may include the directional couplers as illustrated in FIG. 2 and the accompanying description. Reflected beam cancellation is performed for both Beam 1 and Beam 2 on each row. However, for purposes of clarity and explanation, Beam 1 cancellation is illustrated for Row 1 and Beam 2 cancellation is illustrated on Row N.

Beam 1 downtilt control 32 divides Beam 1 into N signals with progressive phase shifts to effect an electrical downtilt. Referring to Row 1, Beam 1 and Beam 2 are input into reflection cancellation circuit 34. Solid arrows indicate RF signal flow in the transmit direction. Beam 1 is output from reflection cancellation circuit on the Beam 1 path and provided to an input on a hybrid coupler 34. Hybrid coupler 34 divides Beam 1 in two signals of equal amplitude and outputs Beam 1 on both ports. Hybrid coupler 36 also applies a 90° phase shift to Beam 1 on one of the output ports. The outputs of hybrid coupler 36 are applied to radiating elements 38.

Dashed lines from radiators 38 to hybrid coupler 36 indicate a reflected portion of Beam 1. Because hybrid coupler 36 is a passive element, hybrid coupler 36 combines the Beam 1 reflections, injects them into the receive path of Beam 2.

Reflection cancellation circuit 34 cancels the Beam 1 reflections on the Beam 2 port by extracting a portion of Beam 1, applying a phase delay, and applying the signal to the Beam 2 path.

Although the examples given above are made with respect to two columns/two beams, the invention can be expanded to three or more beams and/or columns to improve the isolation between the beams. For example, in a three-beam example, the reflection-cancellation technique may be applied to the two outer beams, which would typically be directed at equal but opposite angles from boresight. No reflection cancellation is necessary for a center beam in a three beam example.

Figure 4:
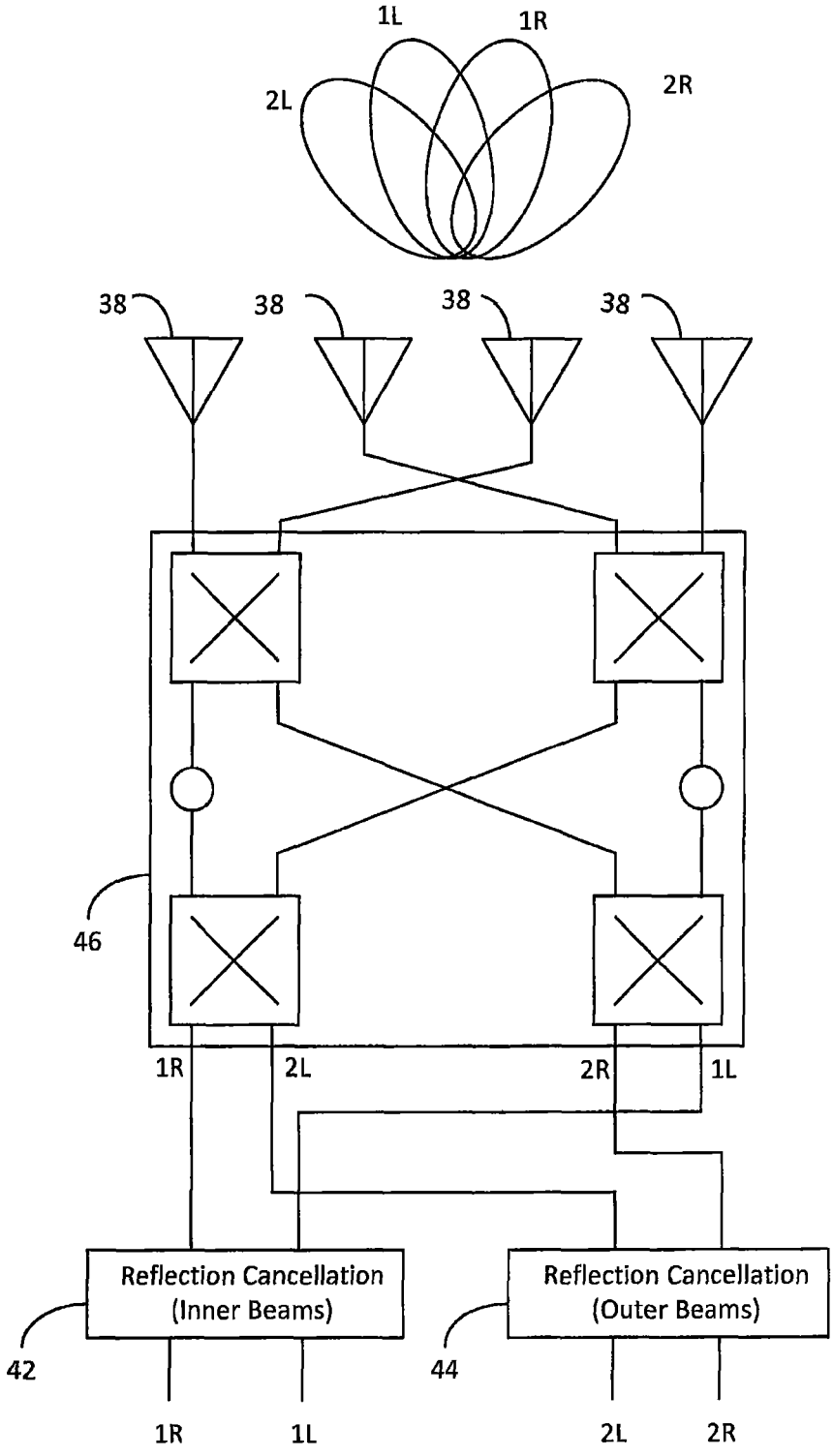
FIG. 4 illustrates a multi-beam antenna according to another aspect of the present invention.

In another example, in a four beam system, a first reflection cancellation would be applied between outer beams, whereas a second cancellation would be applied between inner beams. For example, in FIG. 4, a four beam, four column (4×4 BFN) multi-beam antenna and feed network 40 is illustrated. The feed network has four inputs, 1R, 1L, 2R, 2L, producing corresponding beams as illustrated.

The inner beam inputs (1R, 1L) are coupled to a first reflection cancellation circuit 42. The outer beam inputs (2R, 2L) are coupled to a second reflection cancellation circuit 44, The reflection cancellation circuits 42, 44, are connected to Butler matrix 46, Butler matrix 46 may comprise a conventional Butler matrix, Butler, matrix 46 is coupled to antenna elements 38.

Because inner beams 1L and 1R are oriented at equal but opposite angles from bore sight, those beams would reflect into each other's receive path, which is canceled or substantially reduced by reflection cancellation circuit 42. Outer beams 2R, 2L are also at opposite and equal angles, but at wider angles than 1R and 1L. Accordingly, reflections from 2R to 2L, and vice-versa, are cancelled or substantially reduced in the second reflection cancellation circuit 44.

What is claimed is:

1. A feed network, comprising a. a first beam port;

b. a second beam port;

c. a third beam port;

d. a fourth beam port;

e. a Butler matrix;

f. a first cancellation circuit coupled between the first beam port and the second beam port and the Butler matrix, the cancellation circuit configured to extract a portion of a RF signal on the first beam port and add phase delay thereto to provide a first extracted, delayed signal, and to inject the first extracted, delayed signal from the first beam port onto the second beam port, and to extract a portion of a RF signal on the second beam port and add phase delay thereto to provide a second extracted, delayed signal, and to inject the second extracted, delayed signal from the second beam port onto the first beam port; and g. a second cancellation circuit coupled between the third beam port and the fourth beam port and the Butler matrix, the cancellation circuit configured to extract a portion of a RF signal on the third beam port and add phase delay thereto to provide a third extracted, delayed signal, and to inject the third extracted, delayed signal from the third beam port onto the fourth beam port, and to extract a portion of a RF signal on the fourth beam port and add phase delay thereto to provide a fourth extracted, delayed signal, and to inject the fourth extracted, delayed signal from the fourth beam port onto the third beam port.

2. An antenna comprising the feed network of claim 1, wherein the Butler matrix is further coupled to an array of radiating elements, and wherein a. the portion of the RF signal extracted from the first beam port is approximately equal in amplitude to a first beam port RF signal that is reflected by the radiating elements and propagated down a receive path of the second beam port by the Butler matrix;

b. the portion of the RF signal extracted from the second beam port is approximately equal in amplitude to a second beam port RF signal that is reflected by the radiating elements and propagated down a receive path of the first beam port by the Butler matrix;

c. the portion of the RF signal extracted from the third beam port is approximately equal in amplitude to a third beam port RF signal that is reflected by the radiating elements and propagated down a receive path of the fourth beam port by the Butler matrix; and d. the portion of the RF signal extracted from the fourth beam port is approximately equal in amplitude to a fourth beam port RF signal that is reflected by the radiating elements and propagated down a receive path of the third beam port by the Butler matrix.

3. The antenna of claim 2, wherein:

a. the portion of the RF signal extracted from the first beam port is phase shifted to be approximately opposite in phase to the first beam port RF signal that is reflected by the radiating elements and propagated down the receive path of the second beam port by the Butler matrix;

b. the portion of the RF signal extracted from the second beam port is phase shifted to be approximately opposite in phase to the second beam port RF signal that is reflected by the radiating elements and propagated down the receive path of the first beam port by the Butler matrix;

c. the portion of the RF signal extracted from the third beam port is phase shifted to be approximately opposite in phase to the third beam port RF signal that is reflected by the radiating elements and propagated down the receive path of the fourth beam port by the Butler matrix; and d. the portion of the RF signal extracted from the fourth beam port is phase shifted to be approximately opposite in phase to the fourth beam port RF signal that is reflected by the radiating elements and propagated down the receive path of the third beam port by the Butler matrix.

4. The feed network of claim 1, wherein the first cancellation circuit comprises a directional coupler on the first beam input, a transmission line, and a directional coupler on the second beam input; and wherein the second cancellation circuit comprises a directional coupler on the third beam input, a transmission line, and a directional coupler on the fourth beam input.

5. A multi-beam antenna, comprising a. a first beam port;

b. a second beam port;

c. an array of radiating elements;

d. a beam-forming network having inputs coupled to the first beam port and to the second beam port and having outputs coupled to the array of radiating elements; and e. a cancellation circuit coupled between the beam-forming network and the first and second beam ports, the cancellation circuit configured to extract a portion of a first radio frequency (RF) signal on a first transmission path between the first beam port and the beam-forming network and add phase delay thereto to provide a first extracted, delayed signal, and to inject the first extracted, delayed signal onto a second transmission path between the second beam port and the beam-forming network, and to extract a portion of a second RF signal on on the second transmission path and add phase shift thereto to provide a second extracted, delayed signal, and to inject the second extracted, delayed signal onto the first transmission path.

6. The antenna of claim 5, wherein the cancellation circuit comprises a first directional coupler on a first beam input path, a transmission line, a second directional coupler on a second beam input path.

7. The antenna of claim 5, wherein the beam forming network comprises a 90° hybrid coupler.

8. The antenna of claim 5, wherein:

a. the portion of the RF signal extracted from the first transmission path is approximately equal in amplitude to a first beam port RF signal that is reflected by the radiating elements and propagated down the second transmission path by the beam-forming network; and b. the portion of the RF signal extracted from the second transmission path is approximately equal in amplitude to a second beam port RF signal that is reflected by the radiating elements and propagated down the first transmission path by the beam-forming network.

9. The antenna of claim 8, wherein:

a. the portion of the RF signal extracted from the first beam port is phase shifted to be approximately opposite in phase to the first beam port RF signal that is reflected by the radiating elements and propagated down the receive path of the second beam port by the beam-forming network; and b. the portion of the RF signal extracted from the second beam port is phase shifted to be approximately opposite in phase to the second beam port RF signal that is reflected by the radiating elements and propagated down the receive path of the first beam port by the beam-forming network.

10. A multi-beam antenna, comprising a first beam port;

a second beam port;

a beam-forming network;

a cancellation circuit having a first input that is coupled to the first beam port, a second input that is coupled to the second beam port, a first output that is coupled to a first input of the beam-forming network and a second output that is coupled to a second input of the beam-forming network; and a plurality of radiating elements that are coupled to respective outputs of the beam-forming network, wherein the cancellation circuit is configured to extract a portion of a first radio frequency (RF) signal that is input at the first beam port, add phase delay to the extracted portion of the first RF signal, and inject the extracted and phase delayed portion of the first RF signal onto a transmission path between the second beam port and the beam-forming network, and to extract a portion of a second RF signal that is input at the second beam port, add phase delay to the extracted portion of the second RF signal, and inject the extracted and phase delayed portion of the second RF signal onto a transmission path between the first beam port and the beam-forming network.

11. The multi-beam antenna of claim 10, wherein the cancellation circuit comprises a first directional coupler interposed along the transmission path between the first beam port and the beam-forming network a first beam input path, a transmission line, and a second directional coupler interposed along the transmission path between the second beam port and the beam-forming network.

12. The multi-beam antenna of claim 10, wherein the beam-forming network comprises a Butler matrix.

13. The multi-beam antenna of claim 11, wherein the beam-forming network comprises a 90° hybrid coupler.

14. The multi-beam antenna of claim 10, wherein:

the extracted and phase delayed portion of the first RF signal is approximately equal in amplitude to a portion of the first RF signal that is reflected by the radiating elements through the beam-forming network onto the transmission path between the first beam port and the beam-forming network; and the extracted and phase delayed portion of the second RF signal is approximately equal in amplitude to a portion of the second RF signal that is reflected by the radiating elements through the beam-forming network onto the transmission path between the second beam port and the beam-forming network.

15. The multi-beam antenna of claim 14, wherein:

the extracted and phase delayed portion of the first RF signal is phase shifted to be approximately opposite in phase to the portion of the first RF signal that is reflected by the radiating elements through the beam-forming network onto the transmission path between the first beam port and the beam-forming network; and the extracted and phase delayed portion of the second RF signal is phase shifted to be approximately opposite in phase to the portion of the second RF signal that is reflected by the radiating elements through the beam-forming network onto the transmission path between the second beam port and the beam-forming network.

* * * * *